US012774834B2

(12) United States Patent
Mercer et al.

(10) Patent No.: US 12,774,834 B2
(45) Date of Patent: Oct. 27, 2026

(54) HEAT PUMP SYSTEMS AND METHODS FOR DEFROST HUMIDIFICATION

(71) Applicant: Rheem Manufacturing Company, Atlanta, GA (US)

(72) Inventors: Kevin Mercer, Danville, IN (US); Aaron Patrick Gorman, New Braunfels, TX (US)

(73) Assignee: Rheem Manufacturing Company, Atlanta, GA (US)

( * ) Notice: Subject to any disclaimer, the term of this patent is extended or adjusted under 35 U.S.C. 154(b) by 206 days.

(21) Appl. No.: 18/407,970

(22) Filed: Jan. 9, 2024

(65) Prior Publication Data

US 2024/0230178 A1 Jul. 11, 2024

Related U.S. Application Data

(60) Provisional application No. 63/438,406, filed on Jan. 11, 2023.

(51) Int. Cl.
*F25B 41/20* (2021.01)
*F25B 13/00* (2006.01)
*F25B 41/40* (2021.01)

(52) U.S. Cl.
CPC ..... *F25B 41/20* (2021.01); *F25B 13/00* (2013.01); *F25B 41/40* (2021.01); *F25B 2600/2513* (2013.01)

(58) Field of Classification Search
CPC ..... F24F 13/222; F24F 13/224; F24F 13/32; F24F 2013/225; F25B 13/00;
(Continued)

(56) References Cited

U.S. PATENT DOCUMENTS 4,313,314 A * 2/1982 Boyanich ..... F25B 43/006 62/324.1
6,289,685 B1 * 9/2001 Utsumi ..... F25B 29/003 62/238.7

(Continued)

FOREIGN PATENT DOCUMENTS

CN 114746701 A 7/2022
EM 008835524-0002 1/2022

(Continued)

*Primary Examiner* — Henry T Crenshaw
(74) *Attorney, Agent, or Firm* — Eversheds Sutherland (US) LLP

(57) ABSTRACT

Systems and methods for heating and humidifying an interior space using a heat pump are provided. The heat pump may be a window unit and may include a catch for collecting condensation forming on heat exchanger coils positioned in an exterior environment. Using a humidification system, the condensation may be directed via a toward and distributed on (e.g., via dripping and/or spraying) an exterior of heat exchanger coils positioned in an interior environment. A heating channel may be designed to circulate heated fluid (e.g., heated refrigerant) near or around the humidification system to maintain the fluid in a liquid state. The humidification system may include one or more filters and/or chemical agents for removing impurities in the condensation. The heat pump with the humidification system may simultaneously heat and humidify an interior space.

19 Claims, 7 Drawing Sheets

(58) Field of Classification Search
CPC .. F25B 2600/2513; F25B 41/20; F25B 41/40; F25B 47/025
See application file for complete search history.

(56) References Cited

U.S. PATENT DOCUMENTS

| | | | | |
|---|---|---|---|---|
| 10,775,054 | B2 | 9/2020 | Bradford et al. | |
| 11,498,163 | B2 | 11/2022 | Li et al. | |
| 11,619,402 | B2 | 4/2023 | Bradford et al. | |
| 11,781,758 | B2 | 10/2023 | Bradford et al. | |
| 12,072,131 | B2 * | 8/2024 | Rite | F25B 39/00 |
| 2013/0219951 | A1 * | 8/2013 | Hyun | F25B 41/37 29/428 |
| 2014/0216093 | A1 * | 8/2014 | Kaiser | F24F 13/222 62/285 |
| 2023/0059481 | A1 | 2/2023 | Li et al. | |
| 2023/0125880 | A1 | 4/2023 | Analytis et al. | |
| 2023/0126498 | A1 | 4/2023 | Li et al. | |
| 2023/0130691 | A1 | 4/2023 | Shah et al. | |
| 2023/0332778 | A1 * | 10/2023 | Vakiloroaya | F28D 1/0461 |
| 2024/0003552 | A1 | 1/2024 | Bradford et al. | |

FOREIGN PATENT DOCUMENTS

| | | | |
|---|---|---|---|
| EM | 008835524-0003 | | 1/2022 |
| EP | 4028696 | A1 | 7/2022 |

* cited by examiner

HEAT PUMP SYSTEMS AND METHODS FOR DEFROST HUMIDIFICATION

CROSS-REFERENCE TO RELATED APPLICATIONS

This application claims priority to and benefit of U.S. provisional patent application No. 63/438,406 filed Jan. 11, 2023, which is herein incorporated by reference.

TECHNICAL FIELD

The present disclosure is generally in the field of heat pumps. For example, systems and methods are provided herein for heat pumps with defrost and humidifying functionality.

BACKGROUND

Heat pump systems heat and cool fluids such as refrigerants for heat exchange with interior spaces (e.g., for residential and commercial use). For example, a heat pump system may include condenser coils and evaporator coils as well as a reversing valve for reversing the direction of the refrigerant. When the reversing valve is in a first direction, the heat pump system may cause heating for conditioning the indoor space. When desirable, the reversing valve may be actuated to transition to a second direction to cause the heat pump system to move the refrigerant in a reverse direction to cause cooling of the indoor space.

In urban and high density areas, heat pump systems may be specifically designed to be installed in a window space or other spaces having an opening between an indoor environment and an outdoor environment. For example, heat pumps may be designed to rest on and to be secured to a window sill or other window structure of an apartment, house, office building, or the like. Such heat pumps may include a portion that is designed to extend into the interior space and a portion that is designed to extend into the exterior space. A first set of heat exchanger coils may be positioned in the portion of the heat pump positioned outside and a second set of heat exchanger coils may be positioned in the portion of the heat pump extending into the interior space.

Such window units are known to generate unwanted condensation in the exterior, outside coils portion, during the defrost mode. Condensation may collect on the outside coils and may fall or otherwise deposit onto the building structure, a heat pump positioned below, or other surfaces and/or objects positioned below. Such condensation may be harmful and/or offensive to the structures and/or objects below. Such condensation may also freeze and cause other inconveniences or problems for the system.

Accordingly, there is a need for improved methods and systems for collecting and redirecting the condensation forming on and falling from the heat exchanger coils that are positioned outside or in the exterior.

DETAILED DESCRIPTION

Improved heat pump systems have been developed which are capable of capturing condensation from an exterior environment and distributing the condensation to an interior environment for humidifying the interior environment during a heating mode. The heat pump system may include heat exchanger coils in the exterior environment and heat exchanger coils in the interior environment and may capture condensation forming on the heat exchanger coils in the exterior environment and direct the captured condensation to the heat exchanger coils in the interior environment for applying the captured condensation to an exterior of the coils in the interior environment. The coils in the interior environment may be heated to convert liquid condensation to a gaseous, or vapor, state for humidifying the interior space.

Figure 1:
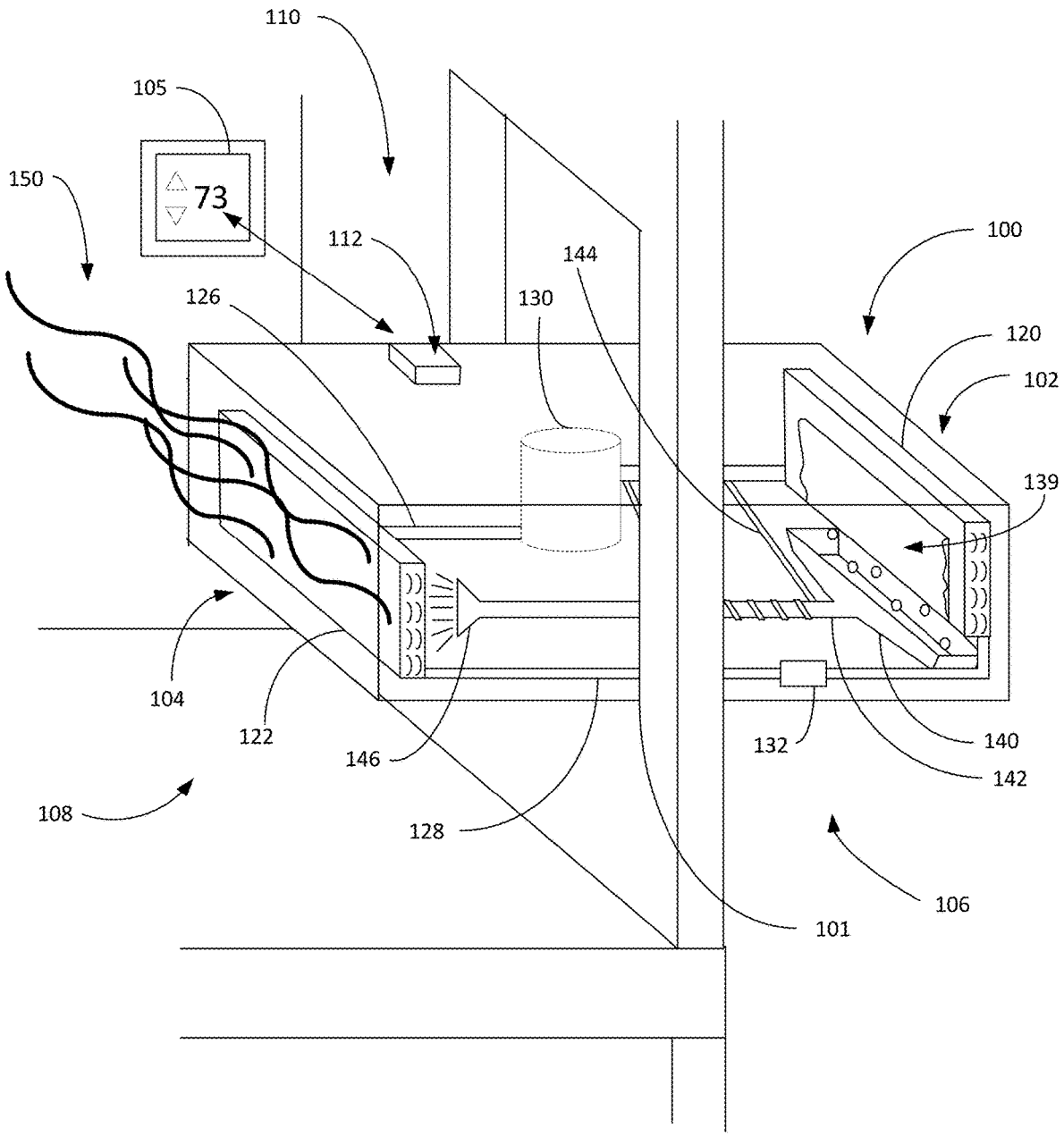
FIG. 1 is a perspective view of a heat pump system with a humidification system positioned in the window of a building in accordance with one or more example embodiments of the disclosure.

Referring now to FIG. 1, a heat pump system 110 including a heat pump 100 having a humidification system is illustrated. As shown in FIG. 1, heat pump 100 may be a heat pump system that may be designed to rest upon and/or be secured to window structure 101, which may be a window frame and/or windowsill, or any other window structure. Alternatively, heat pump 100 may be positioned in any other non-window wall opening. Heat pump 100 may be both a cooling system and a heating system.

Heat pump 100 may be U-shaped, or saddle-shaped, such that exterior portion 102 may be positioned in exterior environment 106 and interior portion 104 may be positioned in interior environment 108. Interior environment 108 may be any interior structure. For example, interior environment 108 may be an apartment, condo, house, office building, and the like. Exterior environment 106 may be the exterior of a building and may be exposed to the exterior environment including rain, snow, sleet, animals, birds, dust, dirt, and various substances and impurities.

Heat pump system 110 may include heat pump 100 and optionally controller 105, which may be external to heat pump 100 (e.g., may be positioned on an interior wall inside the a room near heat pump 100). Controller 105 may be any type of computing device with a processor (e.g., tablet, laptop, desktop computer, smart phone or the like). Controller 105 may be in communication with controller 112, which may similarly include a processor and may be housed in heat pump 100 and may control the operation and performance of heat pump 100. Controller 105 may communicate with controller 112 via any well-known wired or wireless system (e.g., Bluetooth, Bluetooth Low Energy (BLE), near field communication protocol, Wi-Fi, cellular network, etc.).

A user may use controller 105 to select desired heating modes and operation of heat pump 100. Alternatively, heat pump system 110 may only include heat pump 100 with controller 112 and heat pump 100 may include a controls and/or interfaces (e.g., a touch screen, buttons, and/or knobs) to control controller 112 and heat pump 100. Accordingly, it is understood that controller 105 may be optional.

Heat pump 100 may include heat exchanger coils 120, which may be positioned outside of interior environment 101 but the housing of heat pump 100, and heat exchanger coils 122, which may be positioned inside of interior environment 101 and inside of the housing of heat pump 100. Heat exchanger coils 120 and heat exchanger coils 122 may be designed to receive and recirculate a fluid, such as a refrigerant. Heat exchanger coils 120 and heat exchanger coils 122 may each include a tubular structure designed to coil about heat exchanger coils 120 and heat exchanger coils 122. It is understood that heat exchanger coils 120 and heat exchanger coils 122 may further be in contact with one or more heat exchanger fins for exchanging thermal energy with exterior environment 106 and interior environment 108, respectively.

In heat mode, heat exchanger coils 120 may be evaporator coils with cooled fluid traversing heat exchanger coils 120 and heat exchanger coils 122 may be condenser coils with heated fluid traversing heat exchanger coils 122. In cool mode and/or defrost mode, heat exchanger coils 122 may be evaporator coils with cooled fluid traversing heat exchanger coils 122 and heat exchanger coils 120 may be condenser coils with heated fluid traversing heat exchanger coils 120. In FIG. 1, heat pump 100 may be in defrost mode causing condensation 139 to deposit into catch 140.

Heat exchanger coils 122 may be in fluid communication with heat exchanger coils 120 via connection 128 and connection 126 such that a continuous loop is formed between heat exchanger coils 122 and heat exchanger coils 120. As shown in FIG. 1, compressor 130 may be positioned between heat exchanger coils 120 and heat exchanger coils 120, and may be in fluid communication with each. Compressor 130 may be any well-known compressor in heat pump systems and may compress the fluid to a heated gaseous state.

Expansion valve 132 may similarly be positioned between heat exchanger coils 120 and heat exchanger coils 120, and may be in fluid communication with each of heat exchanger coils 120 and heat exchanger coils 122. Expansion valve 132 may be any well-known expansion valve in heat pump systems and may cause a decrease in pressure, or throttling expansion, in the fluid. It is understood that one or more valves may be additionally positioned between heat exchanger coils 122 and heat exchanger coils 120.

As shown in FIG. 1, heat pump 101 may further include catch 140 which may be positioned below heat exchanger coils 120. Catch 140 may be a basin, trough, bowl, dish, or any other collection structure that may receive condensation 139 from heat exchanger 120 (e.g., water and/or ice) shedding or otherwise falling from heat exchanger coils 120. It is understood that condensation such as liquid water and/or ice may form on heat exchanger coils 120 during operation of heat pump 100.

Condensation 139 collected at catch 140 may be directed towards heat exchanger coils 122 via channel 142, which may be a humidification channel and/or may be a tubular structure. Heat channel 144 may surround or otherwise come within the vicinity of channel 142 for at least a portion of channel 142. For example, heat channel 144 may spiral about a portion of heat channel 142. Alternatively, or additional, heat channel 144 may enter catch 140 and/or may be positioned near catch 140. It is understood that the heat channel 144 may exchange thermal energy with channel 142 and/or catch 144 to maintain condensation in liquid form.

Heat channel 144 may include an inlet and an outlet on the channel extending between compressor 130 and heat exchanger coils 120. Heat channel 144 may be tubular in structure and may be designed to deliver heated fluid in close proximity to channel 142 to heat channel 142 and/or catch 140. Heat channel 144 may be connected to distributor 146 which may be designed to distribute condensate 139 onto an exterior of heat exchanger coils 122. For example, distributor may be a spray nozzle, spray bar, drip channel and/or any drip system designed to distribute condensation 139 across exterior coils of heat exchanger coils 122. In one example, distributor 146 may be a nebulizer. Channel 142 may also be in fluid connection with catch 140 and distributor 146 via a condensate pump that turns on based on control signal from controller 112.

Heat pump 100 may switch to heating mode to cause condensation 139 deposited over heat exchanger coils 122 to evaporate to increase the humidity of interior space 108. For example, heat pump 100 may cause heat exchanger coils 122 to be condenser coils and may deliver heated fluid to heat exchanger coils 122. The fluid delivered to heat exchanger coils 122 may be of a certain temperature to cause condensation 139 distributed onto an exterior of heat exchanger coils 122 to transition from a liquid state to gaseous state as gaseous condensation 150.

In this manner heat pump 100 may collect condensation that forms on heat exchanger coils 122 and may redistribute the condensation onto heat exchanger coils 122 to humidify interior space 108 while simultaneously discharging condensation 139 from heat pump 100. Accordingly, heat pump 100 may dispose of condensation 139 in a beneficial manner.

Figure 2A:
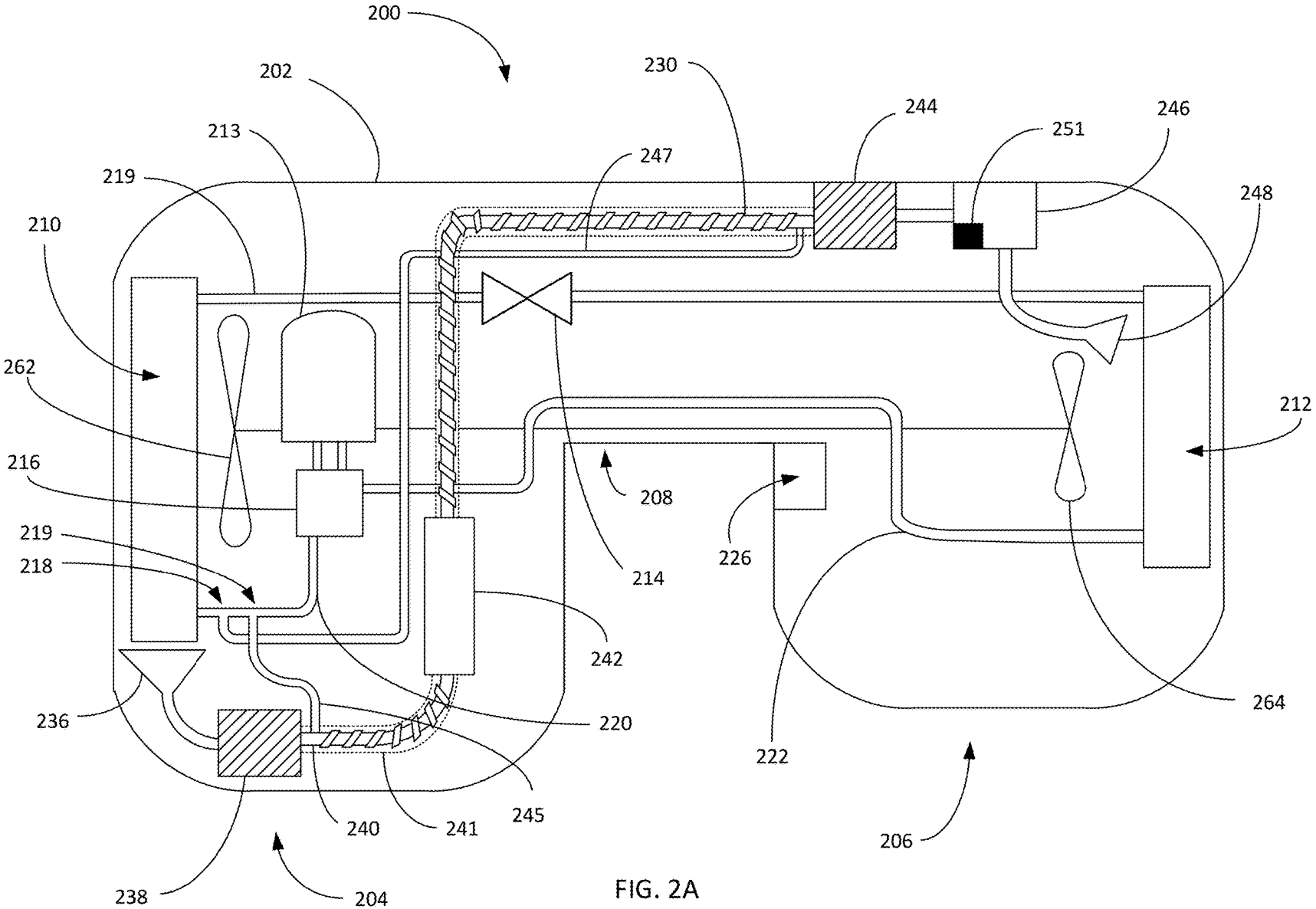
FIG. 2A is a schematic illustration of a heat pump system with a humidification system in accordance with one or more example embodiments of the disclosure.

Referring now to FIG. 2A, a schematic illustration of a heat pump with a humidification system is illustrated. Specifically, heat pump 200 is illustrated, which may be the same or similar to heat pump 100 of FIG. 1. Heat pump 200 may include housing 202 which may include several housing portions that may protect the components within heat pump 200 and/or may open to access certain components within heat pump 200. Similar to heat pump 100 of FIG. 1, heat pump 200 may U-shaped and may be designed to rest upon and/or be secured to window structure.

Heat pump 200 may include heat pump portion 204 which may be designed to be positioned on an exterior side of a window structure and heat pump portion 206 which may be designed to be positioned on an interior side of a window structure. Further heat pump portion 208 may be positioned between heat pump portion 204 and heat pump portion 206 and may be designed to rest on and/or be secured to the window structure.

Heat pump 200 may include heat exchanger coils 210 positioned within heat pump portion 204 designed to be positioned in the exterior environment and heat exchanger coils 212 positioned within heat pump portion 206 designed to be positioned in the interior environment (e.g., within a building structure). Heat exchanger coils 210 and heat exchanger coils 212 may be the same as or similar to heat exchanger coils 120 and heat exchanger coils 122 of FIG. 1, respectively.

Heat pump 200 may further include compressor 213 and expansion valve 214. It is understood that compressor 213 and expansion valve 214 may be the same as or similar to compressor 130 and expansion valve 132 of FIG. 1. As shown in FIG. 2A, compressor 213 may be in fluid communication with each of heat exchanger coils 210 and heat exchanger coils 212 via reversing valve 216. Reversing valve 216 may be any well-known reversing valve in the heat-pump space.

Reversing valve 216 may be in fluid communication with an inlet of compressor 213 and may further be in fluid communication with an outlet of compressor 213. Reversing valve 216 may also be in fluid communication heat exchanger coils 210 via channel 220 and heat exchanger coils 212 via channel 222. Heat exchanger coils 212 and heat exchanger coils 210 may also be in fluid communication with expansion valve 214 via channel 219.

It is understood that reversing valve 216 may be actuated by controller 226 and/or an external controller to transition from a first position to a second position to cause the direction of flow of heat pump 100 to switch directions (e.g., thereby selecting whether heat exchangers coils 210 and 212 serve as condenser or evaporator coils). For example, heat exchanger coil 210 may serve as an evaporator in a heating mode and as a condenser in a cooling and/or defrost mode. Similarly, heat exchanger coil 212 may server as a condenser in a heating mode and as an evaporator in a cooling and/or defrost mode.

As heat pump 200 may be U-shaped, channel 240 may require pump 242 to cause fluid traversing channel 240 to be directed between the catch 236 to the first distributor 248. Pump 224 may be any well-known condensate pump in the heat-pump space. It is understood that fewer or greater number of pumps may be used to cause the condensate to be directed from catch 236 to first distributor 248.

Heat pump 200 may further include controller 226, which may be the same or similar to controller 112 of FIG. 1. For example, controller 226 may control the operation of the components of heat pump 100. Controller 226 may be in communication with an exterior controller and/or may include input features on housing 202 and/or otherwise integrated into heat pump 200 and designed such that a user may manipulate the input features (e.g., touch screen, knobs, buttons, etc.) to control controller 226 and thus control heat pump 200.

Heat pump 200 may further include humidification system 230 and heat channel 245 which may exchange thermal energy with at least a portion of humidification system 230. Humidification system 230 may include one or more of catch 236, filter 238, channel 240, pump 242, filter 244, reservoir 246, and first distributor 248. Catch 236 may be the same as or similar to catch 140 of FIG. 1. For example, catch 236 may include a basin, trough, bowl, dish, or any other collection structure that may receive condensation from heat exchanger coils 210, which may be positioned outside. In one example, filter 238 may be a coarse mesh designed to catch items like leaves, leaves, and similar environmental obstructions. Filter 238 may be positioned within heat pump 200 such that is not serviceable. Alternatively, filter 238 may be accessed and serviced via a service door.

Catch 236 may direct the condensation received from heat exchanger coils 210 to filter 238. Filter 238 may be any well-known fluid (e.g., liquid) filter designed to remove impurities from the fluid. For example, filter 238 may be a mesh filter such as a stainless-steel mesh filter.

In one optional example, filter 238 may be integrated with or otherwise may be in fluid communication with a reservoir connected to catch 236. It is understood that filter 238 may alternatively be integrated with filter 238. Alternatively, filter 238 may not be included in heat pump 200 and/or catch 236 may include structure to prevent large obstructions (e.g., leaves) from entering channel 240.

Catch 236 and/or filter 238 may direct the filtered condensation to channel 240 which may be in fluid communication with filter 238 and/or catch 236 at one end and filter 244 and/or reservoir 246 at another end. Channel 240 may be a humidification channel, may be a tubular structure, and may be designed to guide the filtered condensation to filter 244 and/or reservoir 246. Channel may include insulated portion 241, including an insulating material that may extend along or surround some or all of channel 240. Insulated portion 241 may include any well-known insulator (e.g., foam). Filter 244 may be accessed and serviced (e.g., via a service door).

Channel 240 may include pump 242 which may be one or more pumps designed to direct fluid along channel 240 between filter 238 and/or catch 236 to filter 244 and/or reservoir 246. To maintain the condensation received by catch 236 in a flowable liquid form, heat channel 245, which may extend from outlet 218 and outlet 219 positioned between compressor 213 and heat exchanger coils 210.

In a defrost mode in which heated fluid is circulated from compressor 213 to heat exchanger coils 210, heat channel 245 may be designed to receive a portion of the heated fluid (i.e., discharge gas) traveling between compressor 213 and heat exchanger coils 210. In one optional example, outlet/inlet may include one-way valves such that only heated fluid coming from compressor 213 during defrost mode enters channel 245 and not cooler fluid exiting from heat exchanger coils 210 in the heating mode.

As shown in FIG. 2A, heat channel 245 may extend along and/or in close proximity to channel 240 and/or other portions of humidification system 230. For example, heat channel 245 may spiral around channel 240 as channel 240 extends between filter 238 and/or catch 236 and filter 244 and/or reservoir 246. In one example, heat channel 245 may be positioned within insulated portion 241 to optimize heat exchanged between heat channel 245 and channel 240. While return portion 247 of channel 245 is shown outside of insulated portion 241, it is understood that return portion 247 may also be positioned within insulated portion 241.

Channel 240 may further include pump 242 to direct fluid along channel 240 between filter 238 and/or catch 236 and filter 244 and/or reservoir 246. Pump 242 may be any well-known fluid pump for pumping fluids (e.g., condensate) along channel 240 as shown in FIG. 2A.

Filter 244 and reservoir 246 may be standalone components that may be in fluid communication with one another or may be one integrated component such that filter 244 may be integrated in reservoir 246. Filter 244 may be any well-known fluid (e.g., liquid) filter for removing impurities. For example, filter 244 may include a mesh or matrix structure and/or may include a chemical agent for removing impurities (e.g., bacteria). For example, a chemical cartridge may be inserted into filter 244 and may be removable to be refilled and/or refreshed.

Reservoir 246 may receive the fluid from channel 240 and filter 244 and may retain at least a portion of the fluid in reservoir 246. Reservoir 246 may be any well-known reservoir structure (e.g., a basin, trough, bowl, dish, bag, etc.). Reservoir 246 may include a sensor 251 for determining the amount of fluid in reservoir 246. Sensor 251 may be any well-known sensor capable of generating a signal indicative of a presence or amount of fluid (e.g., pressure sensor, optical sensor, etc.).

Heat pump 200 may further include fan 262, which may be positioned in heat pump portion 204 (e.g., outside) and blower 264, which may be positioned in heat pump portion 206 (e.g., inside). Fan 262 may blow air across heat exchanger coils 210 to facilitate thermal energy transfer between heat exchanger 210 and the exterior environment (e.g., via convection heat transfer). Blower 264 may be stand alone with respect to fan 262 or may share a power system and/or drive system (e.g., a common drive shaft). Blower 264 may push air across the coils of heat exchanger coils 212 such that in heating mode, heated air is blown in the interior space and in cooling mode, cool air is blown in the interior space.

Figure 2B:
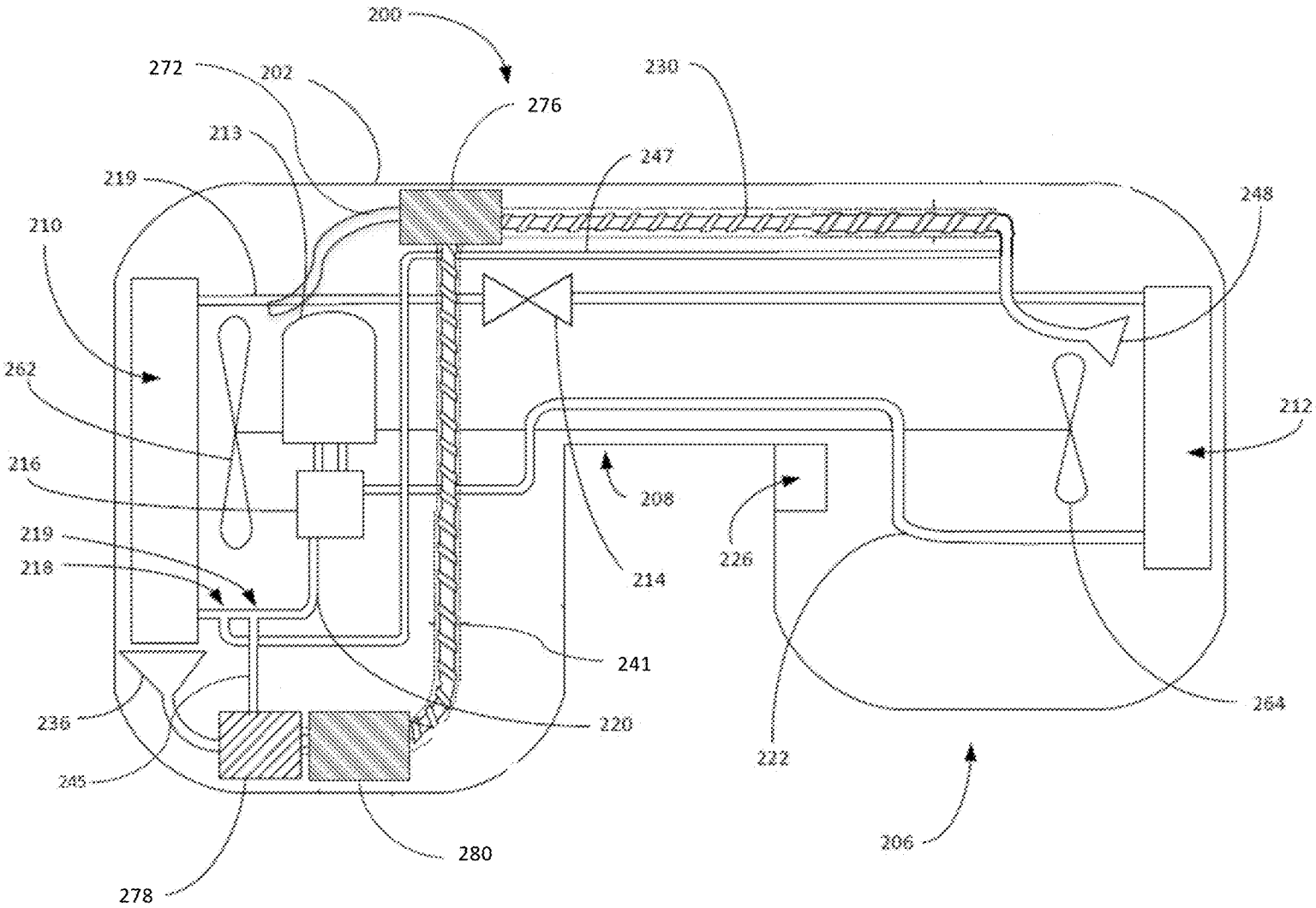
FIG. 2B is another schematic illustration of a heat pump system with a humidification system in accordance with one or more example embodiments of the disclosure.
Figure 3A:
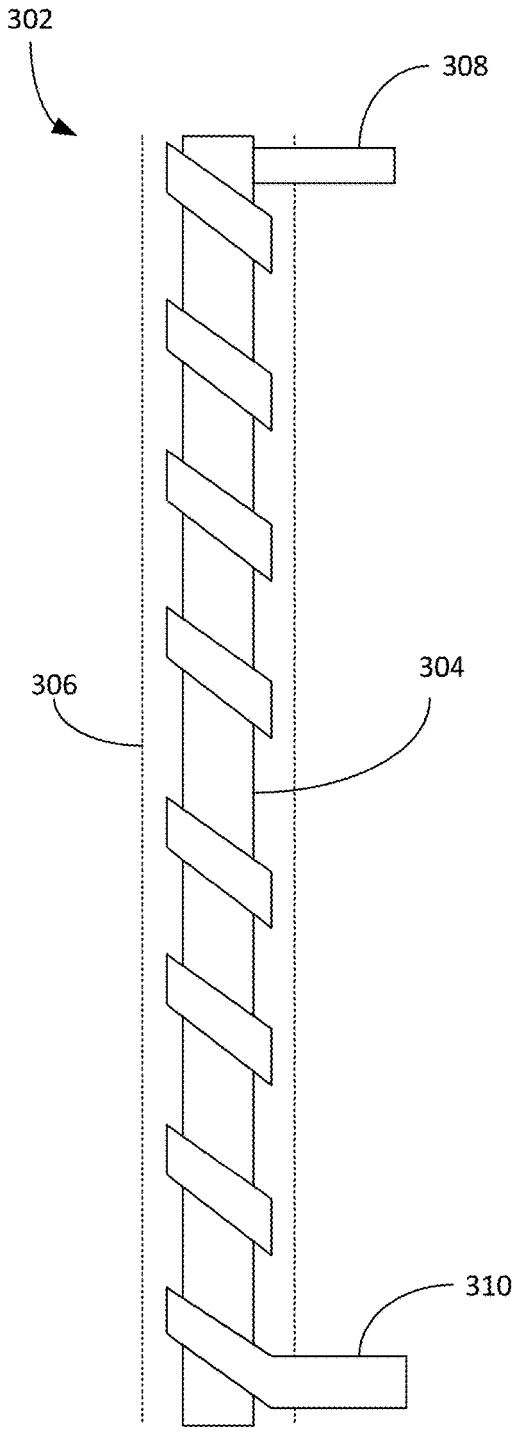
FIGS. 3A-3B are cross-sectional views of a humidification channel and a heating channel in accordance with one or more example embodiments of the disclosure.
Figure 3B:
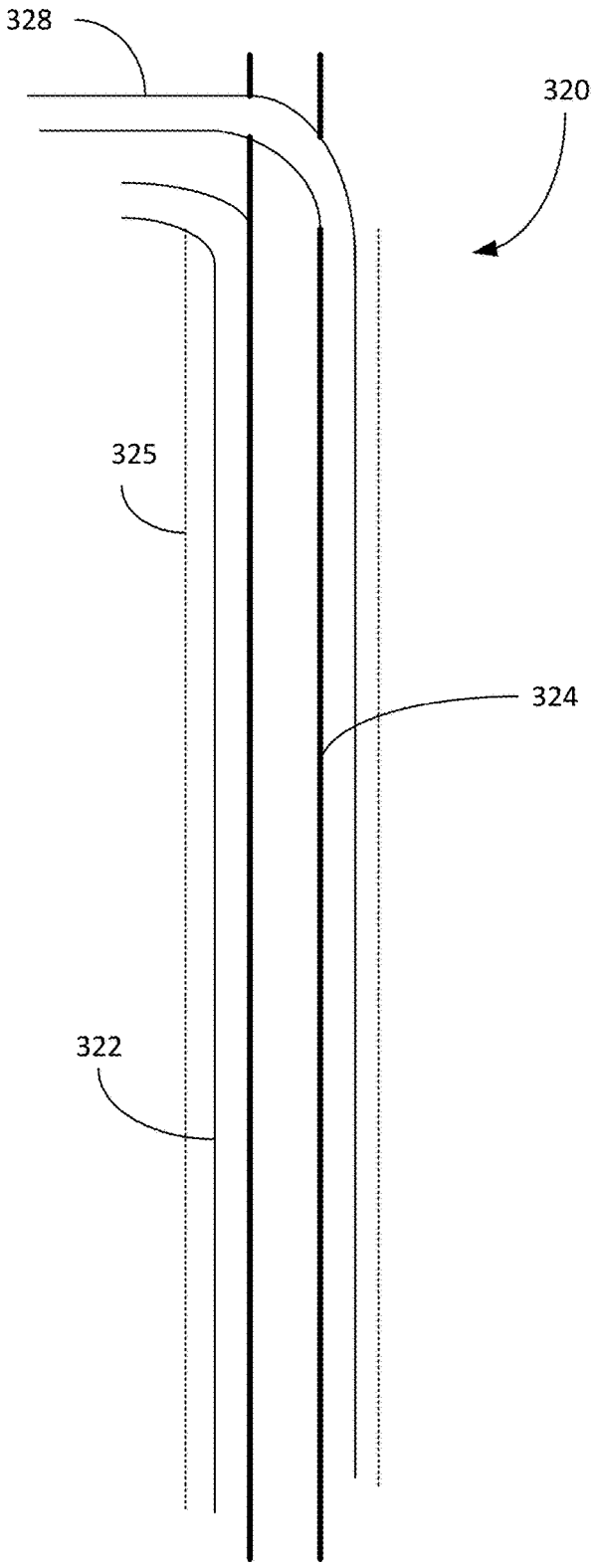

Referring now to FIG. 2B, another schematic illustration of a heat pump 270 with a humidification system is illustrated. Particularly, the heat pump 270 shown in FIG. 2B atomizies the condensate on the outdoor unit for disposal without forming drips. Rather than (or in addition to) dispersing the condensate to the indoor environment, the condensate is atomized and dispersed towards the fan 262 when the fan 262 is on so drips are not formed. The heat pump 270 of FIG. 2B includes similar elements as the heat pump 200 FIG. 2A, however, the heat pump 270 also includes a second distributor 272, a diverter valve 276, a filter 278 (which may also be an ultraviolet light), and an ultrasonic transducer 280 (which may also be a blower). The second distributor 272 is used to distribute vaporized condensate to an outdoor environment and the a first distributor 248 is used to distribute vaporized condensate to an indoor environment. The first distributor 248 and the second distributor 272 may be nozzles, for example. The diverter valve 276 is used for indoor humidification and for outdoor condensate removal. The heated refrigerant line 245 may be directed to the ultrasonic transducer 280 to prevent freezing of the condensate in the ultrasonic transducer 280. Referring now to FIGS. 3A and 3B, channels of the humidification system of a heat pump are illustrated. Referring now to FIG. 3A, insulated channel 302 is illustrated. Insulated channel 302 may be the same as or similar to channel 240 of FIGS. 2A and/or 2B. Insulated channel 302 may include channel 304, which may be the same as or similar to channel 240 of FIGS. 2A and/or 2B and may be designed to guide condensation from the catch below the outdoor heat exchange coils to an exterior of the indoor heat exchange coils. Insulated channel 302 may include insulated portion 306, which may surround channel 304 along a least some of the length of channel 304. Insulated portion 306 may be made from any suitable insulating material (e.g., insulation foam).

Heat channel 308 may be the same as heat channel 245 of FIGS. 2A and/or 2B and may spiral around or otherwise operably be positioned adjacent to channel 304 for at least a portion of channel 304. Heat channel 308 may be designed to exchange heat from heated fluid circulated through heat channel 308 with the condensation fluids and/or solids within channel 304. It is understood that all or some of heat channel 308 may be positioned within insulation portion 306.

Referring now to FIG. 3B, an alternative insulated channel is illustrated. Specifically, insulated channel 320 may include channel 324. Channel 324 may be the same as or similar to channel 240 of FIGS. 2A and/or 2B and may be designed to guide condensation from the catch below the outdoor heat exchange coils to an exterior of the indoor heat exchange coils. Insulated channel 320 may include insulated portion 325, which may surround channel 324 along a least some of the length of channel 324. Insulated portion 325 may be made from any suitable insulating material (e.g., insulation foam).

Heat channel 328 may be similar to heat channel 245 of FIGS. 2A and/or 2B, but instead of spiraling around channel 324, heat channel 328 may be positioned parallel to and alongside of channel 324 for at least a portion of channel 324. Heat channel 328 may be designed to exchange heat from heated fluid circulated through heat channel 328 with the condensation fluids and/or solids within channel 324 (e.g., via conductive and/or any other heat transfer).

Return portion 322 may also be positioned parallel to and alongside of channel 324 for at least a portion of channel 324. Heat channel 328 may be positioned within insulated portion 325, including some or all of return portion 322. Alternatively, return portion 322 may be positioned outside of insulated portion 325. It is understood that insulated portion 306 of FIG. 3A and/or insulated portion 325 of FIG. 3B may be optional.

Figure 4:
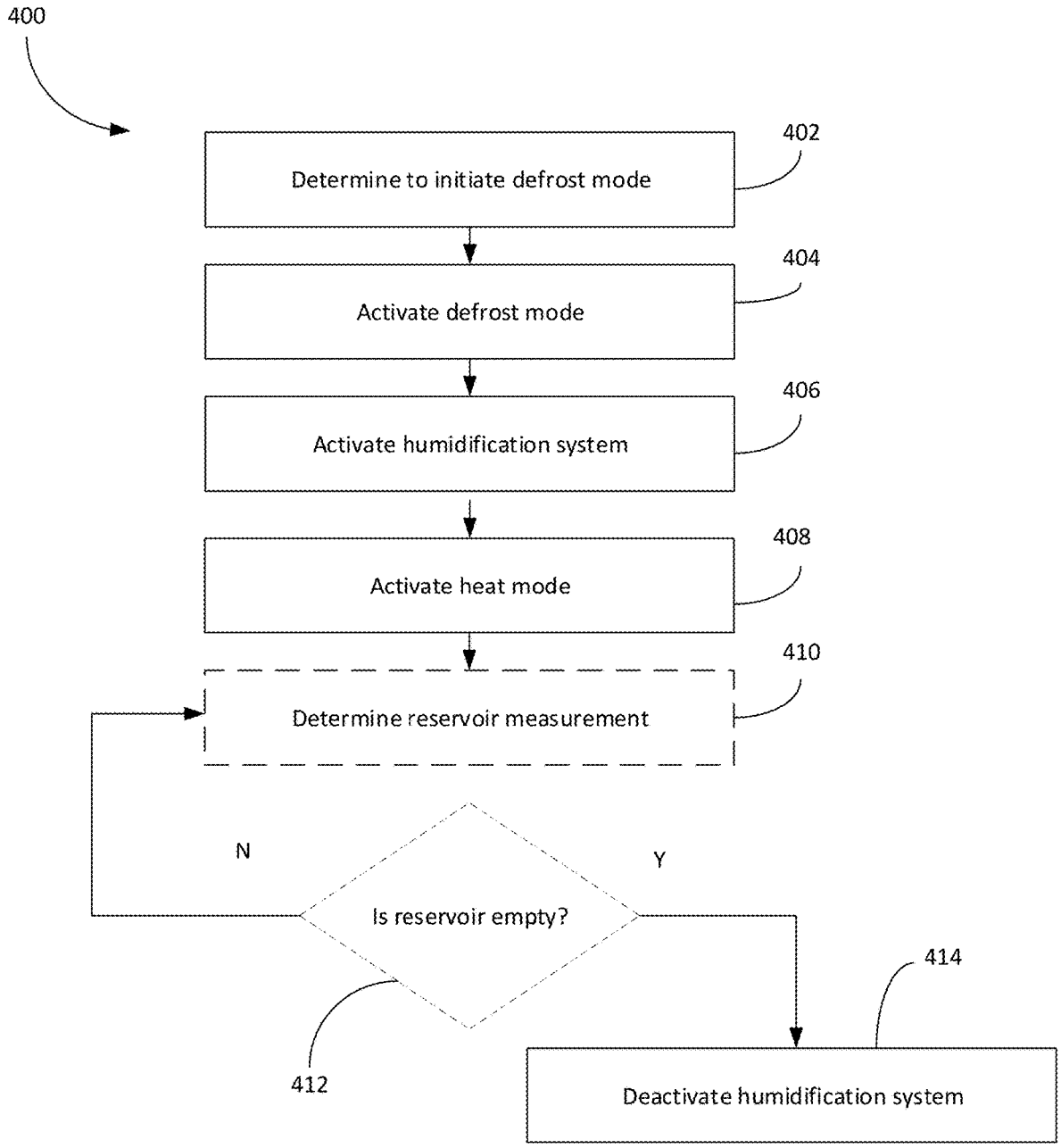
FIG. 4 is a schematic illustration of an example process flow for determining to initiate defrost mode and activating the humidification system in accordance with one or more example embodiments of the disclosure.

Referring now to FIG. 4, example process flow 400 for activating defrost mode and the humidification system is illustrated. The heat pump in process flow 400 may be the same or similar to heat pump 100 of FIG. 1 and/or heat pumps 200 and/or 270 of FIGS. 2A and/or 2B and may include or otherwise communicate with a controller (e.g., a remote controller or controller on the heat pump).

While example embodiments of the disclosure may be described in the context of a controller, it should be appreciated that the disclosure is more broadly applicable to various types of computing devices as well as a controller in combination with a computing device, such as a server and/or smart phone. Some or all of the blocks of the process flows in this disclosure may be performed in a distributed manner across any number of devices. The operations of process flow 400 may be optional and may be performed in a different order.

At block 402, computer-executable instructions stored on a memory of a device, such as a controller, may be executed to initiate a defrost mode. For example, defrost mode may be initiated periodically based on a timer, may be connected to a temperature sensor which may cause defrost mode to be initiated when a certain temperature is reaches, and/or defrost mode may be initiated manually by a user using a controller. During defrost mode, the heat pump may deactivate the blower such that cold air is not blown into the interior space, or may allow cold air to be blown into an interior space. At block 404, computer-executable instructions stored on a memory of a device, such as a controller, may be executed to activate defrost and/or cooling mode. For example, the heat pump may reverse the system from a heating mode to a cooling mode and/or defrost mode using a reversing valve. In this manner the outdoor coils may serve as the condenser in order to defrost the heat exchanger.

At block 406, computer-executable instructions stored on a memory of a device, such as a controller, may be executed to activate a humidification system. The humidification system may include one or more of a catch, a filter near the catch, a channel, a filter at the end of a channel as well as a reservoir and a distributor. Activating the humidification system, or defrost mode, may cause the outdoor heat exchanger coils to heat up and shed condensation formed upon the coils and the catch may receive and/or filter the condensation and send the condensation via the channel to the filter and/or reservoir for distribution by the distributor (e.g., via spraying) onto the internal coils.

At block 408, computer-executable instructions stored on a memory of a device, such as a controller, may be executed to reverse the heat pump to activate heat mode. For example, the reversing valve may be reversed to cause the indoor heat exchange coils to serve as a condenser. At optional block 410, computer-executable instructions stored on a memory of a device, such as a controller, may be executed to determine a reservoir measurement (e.g., how much liquid is in the reservoir). For example, a sensor may be used (e.g., pressure or optical sensor)

At optional decision 412, computer-executable instructions stored on a memory of a device, such as a controller, may be executed to determine if the reservoir is empty. If the reservoir is not empty, the humidification system may continue to be activated and distribute the condensation onto the interior heat exchanger coils. Alternatively, if the reservoir is determined to be empty, at block 414, computer-executable instructions stored on a memory of a device, such as a controller, may be executed to deactivate the humidification system.

Figure 5:
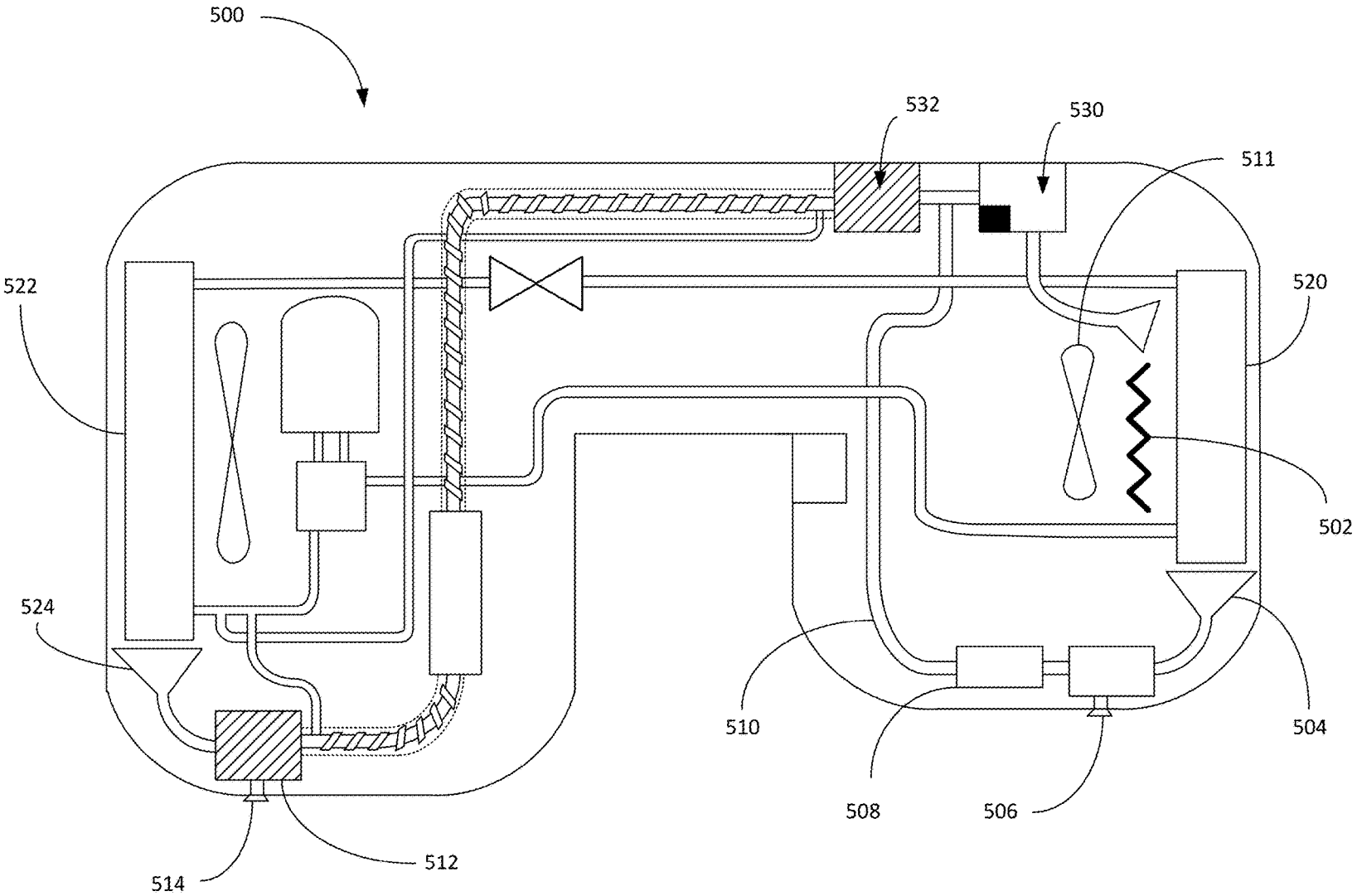
FIG. 5 is a schematic illustration of a heat pump system with a humidification system, resistive coils, and drains in accordance with one or more example embodiments of the disclosure.

Referring now to FIG. 5, a schematic illustration of an alternative heat pump with a humidification system is illustrated. Specifically, heat pump 500 is illustrated, which may be substantially similar to heat pumps 200 and/or 270 of FIGS. 2A and/or 2B. However, unlike heat pumps 200 and/or 270 of FIGS. 2A and/or 2B, heat pump 500 may include resistance coils 502, catch 504, drain 506, pump 508, channel 510 and/or drain 514.

Resistance coils 502 may be any well-known type of electric resistance coils that may generate heat when a current is applied to resistance coils 502. Resistance coils 502 may be positioned in front of blower 511 such that blower may push air over resistance coils 502 in defrost mode and warm air may enter the interior space. Alternatively, resistance coils 502 may be positioned near a different fan and may exit heat pump 500 out of a different outlet than air from fan 511 (e.g., may exit a side of heat pump 500) to avoid heated air traversing heat exchanger coils 520 in defrost mode (e.g., evaporator coils). While resistance coils 502 are shown upstream of heat exchanger coils 520, it is understood that resistance coils 502 may be positioned down stream of heat exchanger coils 520 (e.g., to the right of heat exchanger coils 520).

Catch 504 may be the same or similar to catch 236 of FIGS. 2A and/or 2B, but may be positioned beneath heat exchanger coils 520 to catch any excess condensation from heat exchanger coils 522 that does not evaporate from heat exchanger coils 520. Catch 504 may direct the excess condensation to drain 506 to be disposed from heat pump 500. For example, drain 506 may optionally be connected to plumbing in the interior space.

Pump 508 and channel 510, additionally and/or alternatively, may be in fluid communication with reservoir 530, which may be the same or similar to reservoir 246 of FIGS. 2A and/or 2B, and may direct the excess condensation to reservoir. Alternatively, pump 508 and channel 510 may direct fluid from drain 506 and/or catch 504 to filter 532, which may be the same or similar to filter 244 of FIG. 2.

Filter 512, which may be the same or similar to filter 238 of FIGS. 2A and/or 2B or catch 524, which may be the same or similar to catch 236 of FIGS. 2A and/or 2B may include drain 514, which may be designed to dispose of some or all of the condensation collected by catch 524. It is understood that drain 514 may be connected to plumbing on the exterior of the structure, such as a gray water line that may lead into a planter, for example.

Figure 6:
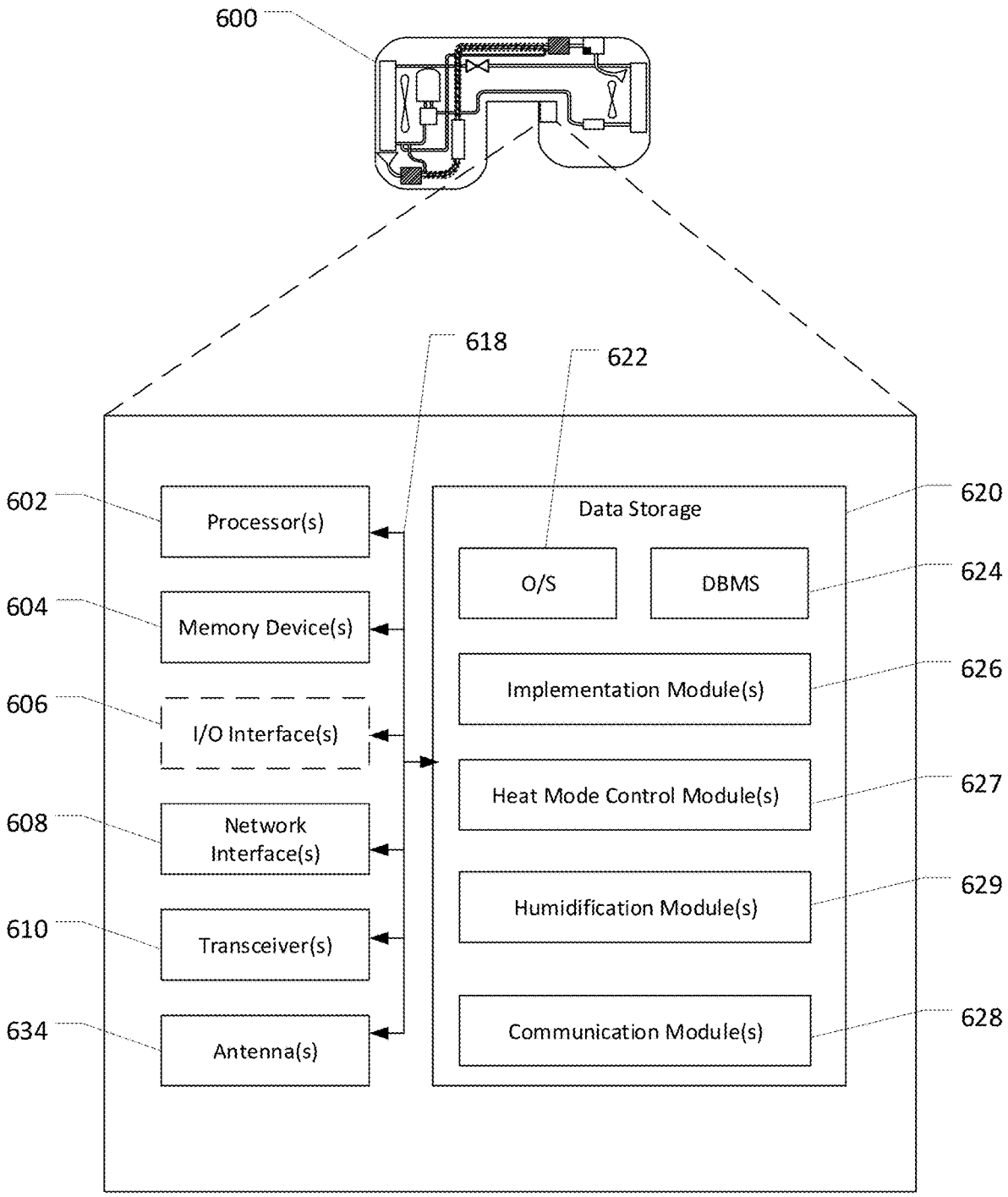
FIG. 6 is a schematic block diagram of a heat pump system in accordance with one or more example embodiments of the disclosure.

Referring now to FIG. 6 a schematic block diagram of an illustrative controller of a heat pump with a humidification system is illustrated. Specifically controller 600 may be incorporated into a heat pump and/or may communicate with a heat pump, in accordance with one or more example embodiments of the disclosure. Controller 600 may be the same or similar to controller 112 of FIG. 1 and/or controller 226 of FIGS. 2A and/or 2B or otherwise may be one or more of the controllers of FIGS. 1-5.

Controller 600 may be configured to communicate with one or more remote controllers, servers, mobile devices, user devices, other systems, or the like. Controller 600 may be configured to communicate via one or more networks. Such network(s) may include, but are not limited to, any one or more different types of communications networks such as, for example, cable networks, public networks (e.g., the Internet), private networks (e.g., frame-relay networks), wireless networks, cellular networks, telephone networks (e.g., a public switched telephone network), or any other suitable private or public packet-switched or circuit-switched networks.

In an illustrative configuration, controller 600 may include one or more processors 602, one or more memory devices 604 (also referred to herein as memory 604), one or more input/output (I/O) interface(s) 606, one or more network interface(s) 608, one or more transceiver(s) 610, one or more antenna(s) 634, and data storage 620. The controller 600 may further include one or more bus(es) 618 that functionally couple various components of the controller 600.

The bus(es) 618 may include at least one of a system bus, a memory bus, an address bus, or a message bus, and may permit exchange of information (e.g., data (including computer-executable code), signaling, etc.) between various components of the controller 600. The bus(es) 618 may include, without limitation, a memory bus or a memory controller, a peripheral bus, an accelerated graphics port, and so forth. The bus(es) 618 may be associated with any suitable bus architecture including.

The memory 604 may include volatile memory (memory that maintains its state when supplied with power) such as random access memory (RAM) and/or non-volatile memory (memory that maintains its state even when not supplied with power) such as read-only memory (ROM), flash memory, ferroelectric RAM (FRAM), and so forth. Persistent data storage, as that term is used herein, may include non-volatile memory. In various implementations, the memory 604 may include multiple different types of memory such as various types of static random access memory (SRAM), various types of dynamic random access memory (DRAM), various types of unalterable ROM, and/or writeable variants of ROM such as electrically erasable programmable read-only memory (EEPROM), flash memory, and so forth.

The data storage 620 may include removable storage and/or non-removable storage including, but not limited to, magnetic storage, optical disk storage, and/or tape storage. The data storage 620 may provide non-volatile storage of computer-executable instructions and other data. The memory 604 and the data storage 620, removable and/or non-removable, are examples of computer-readable storage media (CRSM) as that term is used herein. The data storage 620 may store computer-executable code, instructions, or the like that may be loadable into the memory 604 and executable by the processor(s) 602 to cause the processor(s) 602 to perform or initiate various operations. The data storage 620 may additionally store data that may be copied to memory 604 for use by the processor(s) 602 during the execution of the computer-executable instructions. Moreover, output data generated as a result of execution of the computer-executable instructions by the processor(s) 602 may be stored initially in memory 604, and may ultimately be copied to data storage 620 for non-volatile storage.

The data storage 620 may store one or more operating systems (O/S) 622; one or more optional database management systems (DBMS) 624; and one or more program module(s), applications, engines, computer-executable code, scripts, or the like such as, for example, one or more implementation modules 626, heat mode control modules 627, humidification modules 629, and one or more communication modules 628. Some or all of these modules may be sub-modules. Any of the components depicted as being stored in data storage 620 may include any combination of software, firmware, and/or hardware. The software and/or firmware may include computer-executable code, instructions, or the like that may be loaded into the memory 604 for execution by one or more of the processor(s) 602. Any of the components depicted as being stored in data storage 620 may support functionality described in reference to correspondingly named components earlier in this disclosure.

Referring now to other illustrative components depicted as being stored in the data storage 620, the O/S 622 may be loaded from the data storage 620 into the memory 604 and may provide an interface between other application software executing on the controller 600 and hardware resources of the controller 600. More specifically, the O/S 622 may include a set of computer-executable instructions for managing hardware resources of the controller 600 and for providing common services to other application programs (e.g., managing memory allocation among various application programs). In certain example embodiments, the O/S 622 may control execution of the other program module(s) to for content rendering. The O/S 622 may include any operating system now known or which may be developed in the future including, but not limited to, any server operating system, any mainframe operating system, or any other proprietary or non-proprietary operating system.

The optional DBMS 624 may be loaded into the memory 604 and may support functionality for accessing, retrieving, storing, and/or manipulating data stored in the memory 604 and/or data stored in the data storage 620. The DBMS 624 may use any of a variety of database models (e.g., relational model, object model, etc.) and may support any of a variety of query languages. The DBMS 624 may access data represented in one or more data schemas and stored in any suitable data repository including, but not limited to, databases (e.g., relational, object-oriented, etc.), file systems, flat files, distributed datastores in which data is stored on more than one node of a computer network, peer-to-peer network datastores, or the like.

The optional input/output (I/O) interface(s) 606 may facilitate the receipt of input information by the controller 600 from one or more I/O devices as well as the output of information from the controller 600 to the one or more I/O devices. The I/O devices may include any of a variety of components such as a display or display screen having a touch surface or touchscreen; an audio output device for producing sound, such as a speaker; an audio capture device, such as a microphone; an image and/or video capture device, such as a camera; and so forth. Any of these components may be integrated into the controller 600 or may be separate.

The controller 600 may further include one or more network interface(s) 608 via which the controller 600 may communicate with any of a variety of other systems, platforms, networks, devices, and so forth. The network interface(s) 608 may enable communication, for example, with one or more wireless routers, one or more host servers, one or more web servers, and the like via one or more of networks.

The antenna(s) 634 may include any suitable type of antenna depending, for example, on the communications protocols used to transmit or receive signals via the antenna(s) 634. Non-limiting examples of suitable antennas may include directional antennas, non-directional antennas, dipole antennas, folded dipole antennas, patch antennas, multiple-input multiple-output (MIMO) antennas, or the like. The antenna(s) 634 may be communicatively coupled to one or more transceivers 610 or radio components to which or from which signals may be transmitted or received. Antenna(s) 634 may include, without limitation, a cellular antenna for transmitting or receiving signals to/from a cellular network infrastructure, an antenna for transmitting or receiving Wi-Fi signals to/from an access point (AP), a Global Navigation Satellite System (GNSS) antenna for receiving GNSS signals from a GNSS satellite, a Bluetooth antenna for transmitting or receiving Bluetooth signals including BLE signals, a Near Field Communication (NFC) antenna for transmitting or receiving NFC signals, a 900 MHz antenna, and so forth.

The transceiver(s) 610 may include any suitable radio component(s) for, in cooperation with the antenna(s) 634, transmitting or receiving radio frequency (RF) signals in the bandwidth and/or channels corresponding to the communications protocols utilized by the controller 600 to communicate with other devices. The transceiver(s) 610 may include hardware, software, and/or firmware for modulating, transmitting, or receiving—potentially in cooperation with any of antenna(s) 634—communications signals according to any of the communications protocols discussed above including, but not limited to, one or more Wi-Fi and/or Wi-Fi direct protocols, as standardized by the IEEE 802.11 standards, one or more non-Wi-Fi protocols, or one or more cellular communications protocols or standards. The transceiver(s) 610 may further include hardware, firmware, or software for receiving GNSS signals. The transceiver(s) 610 may include any known receiver and baseband suitable for communicating via the communications protocols utilized by the controller 600. The transceiver(s) 610 may further include a low noise amplifier (LNA), additional signal amplifiers, an analog-to-digital (A/D) converter, one or more buffers, a digital baseband, or the like.

Referring now to functionality supported by the various program module(s) depicted in FIG. 6, the implementation module(s) 626 may include computer-executable instructions, code, or the like that responsive to execution by one or more of the processor(s) 602 may perform functions including, but not limited to, overseeing coordination and interaction between one or more modules and computer executable instructions in data storage 620, determining user selected actions and tasks, determining actions associated with user interactions, determining actions associated with user input, initiating commands locally or at remote devices, and the like.

The heat mode control module(s) 627 may include computer-executable instructions, code, or the like that responsive to execution by one or more of the processor(s) 602 may perform functions including, but not limited to, activating the reversing valve and/or various pumps in the heat pump system to achieve heat mode, cool mode and/or defrost mode.

The communication module(s) 628 may include computer-executable instructions, code, or the like that responsive to execution by one or more of the processor(s) 602 may perform functions including, but not limited to, communicating with one or more devices, for example, via wired or wireless communication, communicating with remote controllers, mobile devices, communicating with servers (e.g., remote servers), communicating with remote datastores and/or databases, sending or receiving notifications or commands/directives, communicating with cache memory data, communicating with user devices, and the like.

The humidification module(s) 629 may include computer-executable instructions, code, or the like that responsive to execution by one or more of the processor(s) 602 may perform functions including, but not limited to, activating, monitoring, and deactivating the humidification system including the distributor used to spray condensation onto the exterior coils of the interior heat exchanger coils or otherwise distribute such condensation.

Although specific embodiments of the disclosure have been described, one of ordinary skill in the art will recognize that numerous other modifications and alternative embodiments are within the scope of the disclosure. For example, any of the functionality and/or processing capabilities described with respect to a particular device or component may be performed by any other device or component. Further, while various illustrative implementations and architectures have been described in accordance with embodiments of the disclosure, one of ordinary skill in the art will appreciate that numerous other modifications to the illustrative implementations and architectures described herein are also within the scope of this disclosure.

Certain aspects of the disclosure are described above with reference to block and flow diagrams of systems, methods, apparatuses, and/or computer program products according to example embodiments. It will be understood that one or more blocks of the block diagrams and flow diagrams, and combinations of blocks in the block diagrams and the flow diagrams, respectively, may be implemented by execution of computer-executable program instructions. Likewise, some blocks of the block diagrams and flow diagrams may not necessarily need to be performed in the order presented, or may not necessarily need to be performed at all, according to some embodiments. Further, additional components and/or operations beyond those depicted in blocks of the block and/or flow diagrams may be present in certain embodiments.

Accordingly, blocks of the block diagrams and flow diagrams support combinations of means for performing the specified functions, combinations of elements or steps for performing the specified functions, and program instruction means for performing the specified functions. It will also be understood that each block of the block diagrams and flow diagrams, and combinations of blocks in the block diagrams and flow diagrams, may be implemented by special-purpose, hardware-based computer systems that perform the specified functions, elements or steps, or combinations of special-purpose hardware and computer instructions.

Program module(s), applications, or the like disclosed herein may include one or more software components, including, for example, software objects, methods, data structures, or the like. Each such software component may include computer-executable instructions that, responsive to execution, cause at least a portion of the functionality described herein (e.g., one or more operations of the illustrative methods described herein) to be performed.

A software component may be coded in any of a variety of programming languages. An illustrative programming language may be a lower-level programming language such as an assembly language associated with a particular hardware architecture and/or operating system platform. A software component comprising assembly language instructions may require conversion into executable machine code by an assembler prior to execution by the hardware architecture and/or platform.

Another example programming language may be a higher-level programming language that may be portable across multiple architectures. A software component comprising higher-level programming language instructions may require conversion to an intermediate representation by an interpreter or a compiler prior to execution.

Other examples of programming languages include, but are not limited to, a macro language, a shell or command language, a job control language, a script language, a database query or search language, or a report writing language. In one or more example embodiments, a software component comprising instructions in one of the foregoing examples of programming languages may be executed directly by an operating system or other software component without having to be first transformed into another form.

A software component may be stored as a file or other data storage construct. Software components of a similar type or functionally related may be stored together such as, for example, in a particular directory, folder, or library. Software components may be static (e.g., pre-established or fixed) or dynamic (e.g., created or modified at the time of execution).

Software components may invoke or be invoked by other software components through any of a wide variety of mechanisms. Invoked or invoking software components may comprise other custom-developed application software, operating system functionality (e.g., device drivers, data storage (e.g., file management) routines, other common routines, and services, etc.), or third-party software components (e.g., middleware, encryption, or other security software, database management software, file transfer or other network communication software, mathematical or statistical software, image processing software, and format translation software).

Software components associated with a particular solution or system may reside and be executed on a single platform or may be distributed across multiple platforms. The multiple platforms may be associated with more than one hardware vendor, underlying chip technology, or operating system. Furthermore, software components associated with a particular solution or system may be initially written in one or more programming languages, but may invoke software components written in another programming language.

Computer-executable program instructions may be loaded onto a special-purpose computer or other particular machine, a processor, or other programmable data processing apparatus to produce a particular machine, such that execution of the instructions on the computer, processor, or other programmable data processing apparatus causes one or more functions or operations specified in the flow diagrams to be performed. These computer program instructions may also be stored in a CRSM that upon execution may direct a computer or other programmable data processing apparatus to function in a particular manner, such that the instructions stored in the computer-readable storage medium produce an article of manufacture including instruction means that implement one or more functions or operations specified in the flow diagrams. The computer program instructions may also be loaded onto a computer or other programmable data processing apparatus to cause a series of operational elements or steps to be performed on the computer or other programmable apparatus to produce a computer-implemented process.

Additional types of CRSM that may be present in any of the devices described herein may include, but are not limited to, programmable random access memory (PRAM), SRAM, DRAM, RAM, ROM, electrically erasable programmable read-only memory (EEPROM), flash memory or other memory technology, compact disc read-only memory (CD-ROM), digital versatile disc (DVD) or other optical storage, magnetic cassettes, magnetic tape, magnetic disk storage or other magnetic storage devices, or any other medium which can be used to store the information and which can be accessed. Combinations of any of the above are also included within the scope of CRSM. Alternatively, computer-readable communication media (CRCM) may include computer-readable instructions, program module(s), or other data transmitted within a data signal, such as a carrier wave, or other transmission. However, as used herein, CRSM does not include CRCM.

Although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may" unless specifically stated otherwise, or otherwise understood within the context as used, is generally intended to convey that certain embodiments could include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

We claim:

1. A heat pump system comprising:

a first coil configured to receive a refrigerant and exchange thermal energy with the refrigerant, the first coil being in fluid communication with at least an expansion valve;

a second coil configured to receive the refrigerant and exchange thermal energy with the refrigerant, the second coil being in fluid communication with the expansion valve;

a compressor in fluid communication with and positioned between the first coil and the second coil;

a first channel configured to receive a condensate from an exterior of the first coil and to guide the condensate towards the second coil; and a second channel comprising an inlet, an outlet, and a guide portion positioned between the inlet and the outlet, the inlet in fluid communication with the compressor and the outlet in fluid communication with the first coil, and the guide portion configured to guide the refrigerant from the inlet to the outlet;

wherein the second channel is configured to exchange thermal energy with at least a portion of the first channel; and wherein an exterior of the second coil is configured to reach a set temperature to cause the condensate to transition from a liquid state to a gaseous state.

2. The heat pump system of claim 1, wherein the first channel further comprises an insulated outer portion configured to insulate the condensate traversing the first channel.

3. The heat pump system of claim 1, wherein the second channel is configured to spiral about the first channel for at least a portion of the first channel.

4. The heat pump system of claim 1, further comprising a catch comprising a filter, the catch being in fluid communication with the first channel via the filter and positioned beneath the first coil to collect the condensate from the first coil.

5. The heat pump system of claim 4, wherein the filter comprises a stainless-steel mesh configured to remove impurities from the condensate.

6. The heat pump system of claim 1, further comprising a catch and a filter in fluid communication with and positioned between the catch and the first channel, the catch being positioned beneath the first coil to collect the condensate from the first coil.

7. The heat pump system of claim 1, wherein the first channel comprises an outlet, the heat pump system further comprising a reservoir in fluid communication with the outlet of the first channel and configured to receive the condensate from the first channel.

8. The heat pump system of claim 7, wherein the reservoir comprises one or more of a filter or a conditioning agent configured to remove impurities from the condensate.

9. The heat pump system of claim 7, further comprising a nozzle in fluid communication with the reservoir and directed towards the second coil, the nozzle being configured to receive condensate from the reservoir and distribute the condensate to an exterior surface of the second coil.

10. The heat pump system of claim 9, wherein the nozzle is configured to drip, spray, or nebulize the condensate.

11. The heat pump system of claim 7, further comprising a catch positioned below the second coil and configured to receive at least a portion of the condensate from an exterior of the second coil.

12. The heat pump system of claim 11, further comprising a third channel and a pump, the third channel in fluid communication with the pump and the catch, the third channel being configured to receive the condensate from the catch and, together with the pump, guide the condensate to the reservoir.

13. The heat pump system of claim 1, further comprising at least one electric resistive coil configured to generate heat.

14. A method for heating and humidification using a heat pump installed on a structure such that the heat pump is positioned inside and outside the structure, the method comprising:

activating, by a controller, a defrost mode of the heat pump, the heat pump comprising a first coil positioned outside the structure and adapted to receive a refrigerant, a second coil positioned inside the structure and adapted to be in fluid communication with the first coil via a compressor and a reversing valve, a channel system adapted to guide a condensate received from an exterior of the first coil, and a heating channel positioned between the compressor and the first coil and adapted to circulate a portion of the refrigerant;

causing the reversing valve to transition from a first position to a second position to cause the refrigerant to heat the first coil;

causing the heating channel to circulate the refrigerant about at least a portion of the channel system;

causing the channel system to direct the condensate towards the second coil;

causing the reversing valve to transition back to the first position to cause the refrigerant to heat the first coil; and causing the channel system to deposit the condensate onto an exterior surface of the second coil after causing the reversing valve to transition back to the first position.

15. The method of claim 14, wherein causing the channel system to deposit the condensate onto an exterior surface of the second coil comprises causing the channel system to drip, spray, or nebulize the second condensate onto the second coil.

16. The method of claim 14, wherein the heat pump further comprises a filter and wherein causing the channel system to direct the condensate towards the second coil causes the condensate to traverse the filter.

17. The method of claim 14, further comprising activating a pump to direct the condensate towards the second coil.

18. The method of claim 14, further comprising activating electrical resistance coils upon causing the reversing valve to transition from the first position to the second position.

19. The method of claim 14, further comprising causing the second coil to reach a set temperature to cause the condensate to transition from a liquid state to a gaseous state.

* * * * *